US006868702B1

(12) United States Patent
Alkire

(10) Patent No.: US 6,868,702 B1
(45) Date of Patent: Mar. 22, 2005

(54) DOOR LOCKING ASSEMBLY

(76) Inventor: Lennard J. Alkire, 2149 Sentito Cir., Henderson, NV (US) 89052

( * ) Notice: Subject to any disclaimer, the term of this patent is extended or adjusted under 35 U.S.C. 154(b) by 0 days.

(21) Appl. No.: 10/642,990

(22) Filed: Aug. 19, 2003

(51) Int. Cl.[7] ..... E05B 67/38; E05C 17/30

(52) U.S. Cl. ..... 70/54; 70/14; 70/DIG. 43; 70/DIG. 56; 70/93

(58) Field of Search ..... 70/54–56, 14–15, 70/158–159, 164, DIG. 43, DIG. 56, 93

(56) References Cited

U.S. PATENT DOCUMENTS

| | | | | | |
|---|---|---|---|---|---|
| 3,280,606 | A | | 10/1966 | Howard et al. | |
| 3,600,026 | A | | 8/1971 | Savio et al. | |
| 3,665,736 | A | | 5/1972 | Wilson | |
| 3,806,179 | A | | 4/1974 | Roesala | |
| 4,078,836 | A | | 3/1978 | Wilson | |
| 4,581,907 | A | * | 4/1986 | Eberly | 70/54 |
| 4,666,106 | A | * | 5/1987 | Kohout | 70/14 |
| 4,760,720 | A | * | 8/1988 | Grille | 70/54 |
| 5,103,659 | A | * | 4/1992 | Benefield, Sr. | 70/164 |
| 5,109,683 | A | * | 5/1992 | Cartwright | 70/14 |
| 5,447,046 | A | | 9/1995 | Duffus | |
| 5,927,107 | A | * | 7/1999 | Mitchell | 70/14 |
| 6,006,556 | A | * | 12/1999 | Daoud | 70/56 |
| 6,601,413 | B1 | * | 8/2003 | Vito | 70/56 |

* cited by examiner

*Primary Examiner*—Daniel P. Stodola
*Assistant Examiner*—Christopher Boswell

(57) ABSTRACT

A door locking assembly includes a locking arm mount that is fixedly attached to a first side of a doorframe. An arm has a first end and a second end. The first end is pivotally coupled to the locking arm mount such that the arm is selectively positionable between a first position extending away from the frame and a second position extending across the door. A loop is attached to the arm and is positioned generally adjacent to the second end of the arm. A lock mount is fixedly attached to a second side of the doorframe and is positioned for removably receiving the loop. A lock may be positioned in the cylinder and positioned on the loop for selectively locking the arm in the second position.

5 Claims, 3 Drawing Sheets

DOOR LOCKING ASSEMBLY

BACKGROUND OF THE INVENTION

1. Field of the Invention

The present invention relates to door locking devices and more particularly pertains to a new door locking device for retrofitting to existing tank type doorframes for selectively locking a door mounted on the doorframe.

2. Description of the Prior Art

The use of door locking devices is known in the prior art. U.S. Pat. No. 5,447,046 describes a bar used for positioning across a door for locking the door. Another type of door locking device is U.S. Pat. No. 3,665,736 that includes a specific design for locking vending machines. Yet another type of door locking device is U.S. Pat. No. 3,806,179 which includes a bar mounted on a conventional doorframe for securing a door.

While these devices fulfill their respective, particular objectives and requirements, the need remains for a locking assembly that is suitable for a tanker or reservoir type doorframe. Such a locking assembly should also be readily retrofittable to existing doorframes as an anti-terrorism device to prevent unlawful entry into fuel tankers and the like.

SUMMARY OF THE INVENTION

The present invention meets the needs presented above by comprising a locking arm mount that is fixedly attached to a first side of a doorframe. An arm has a first end and a second end. The first end is pivotally coupled to the locking arm mount such that the arm is selectively positionable between a first position extending away from the frame and a second position extending across the door. A loop is attached to the arm and is positioned generally adjacent to the second end of the arm. A lock mount is fixedly attached to a second side of the doorframe. The lock mount is positioned such that the second end of the arm may abut the lock mount when the arm is in the second position. The lock mount includes a rod that is attached to the second side. A cylinder has a perimeter wall attached to an end of the rod and is positioned adjacent to the door such that a plane of the door extends through the cylinder. The perimeter wall has a slot extending therethrough that is positioned for receiving the loop. A lock may be positioned in the cylinder and positioned on the loop for selectively locking the arm in the second position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
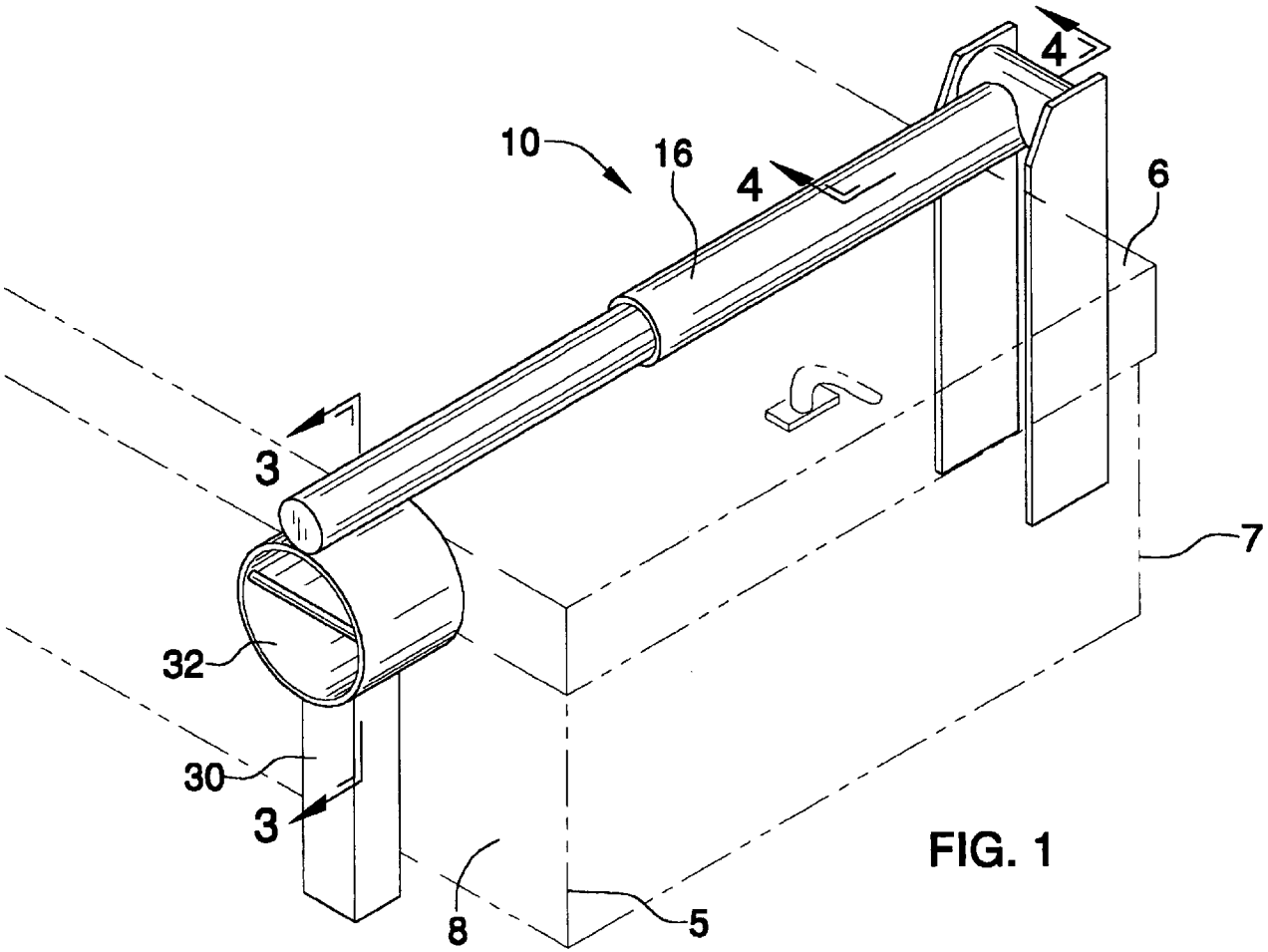
FIG. 1 is a schematic perspective view of a door locking assembly according to the present invention.
Figure 2:
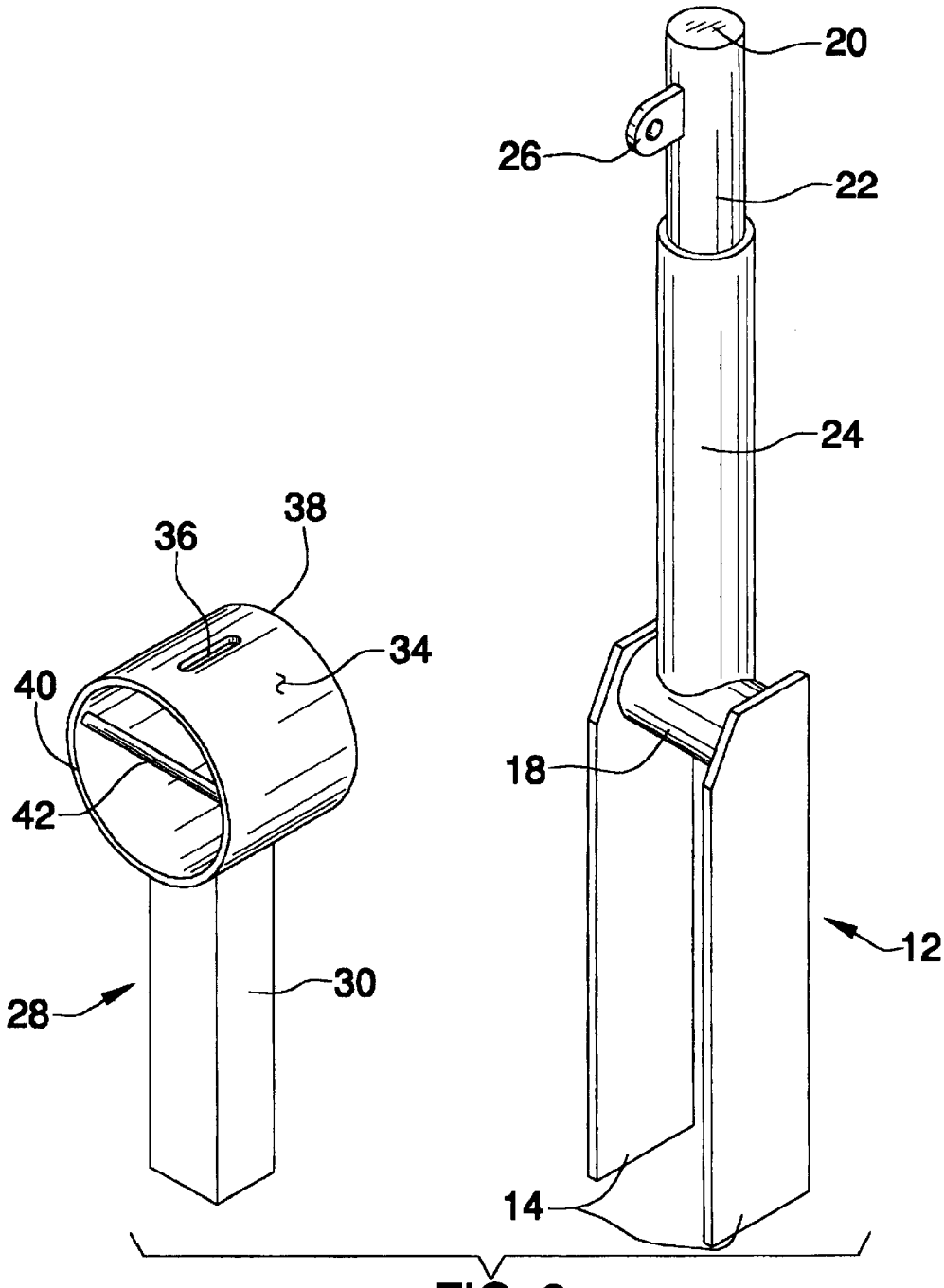
FIG. 2 is a schematic perspective view of the present invention.
Figure 4:
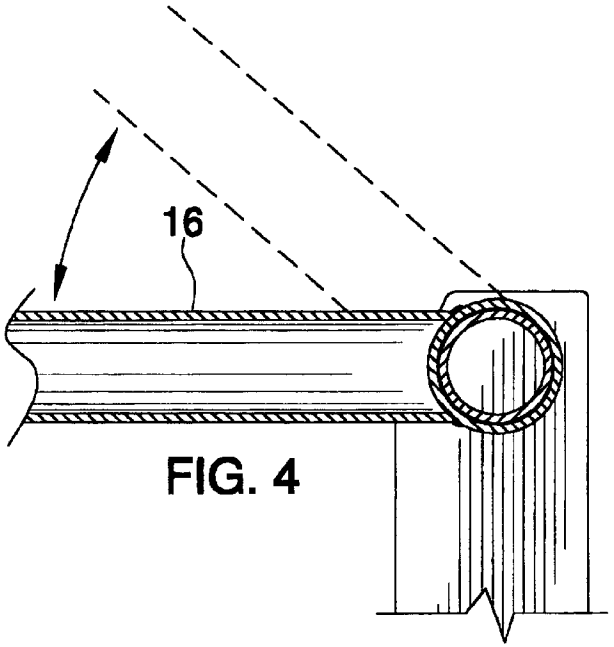
FIG. 4 is a schematic cross-sectional view taken along line 4—4 of FIG. 1 of the present invention.
Figure 5:
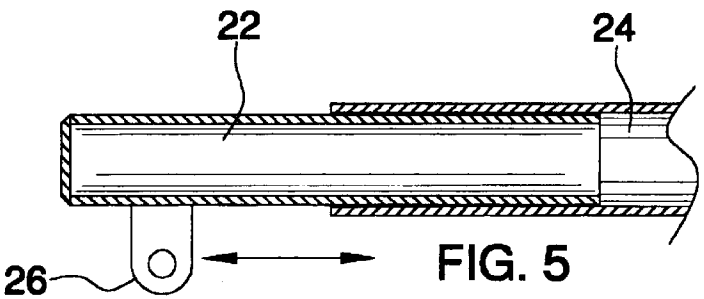
FIG. 5 is a schematic cross-sectional view of the arm of the present invention.
Figure 3:
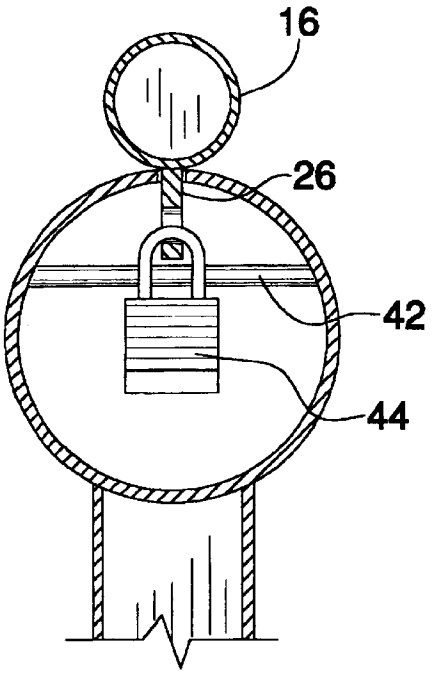
FIG. 3 is a schematic cross-sectional view taken along line 3—3 of FIG. 1 of the present invention.

With reference now to the drawings, and in particular to FIGS. 1 through 5 thereof, a new door locking device embodying the principles and concepts of the present invention and generally designated by the reference numeral 10 will be described.

As best illustrated in FIGS. 1 through 5, the door locking assembly 10 generally comprises a device that is attachable to a doorframe 5 for selectively locking a door 6 in a closed position. The doorframe 5 includes a first side 7 and a second side 8 positioned opposite with respect to each other. The door 6 is mounted on the doorframe 5 such that door 6 may only be opened outwardly. The doorframe 5 and door 6 combination is preferably of the type used for hatch-style covers for tanks and reservoirs.

The locking assembly 10 includes a locking arm mount 12 that is fixedly attached to the first side 7 of the doorframe 5. The locking arm mount 12 includes a pair of plates 14 that are spaced from each other. Each of the plates 14 lies within a plane orientated substantially parallel to each other. The plates 14 are preferably attached to the doorframe 5 by welding, through other mechanical means such as brackets may also be used.

An arm 16 has a first end 18 and a second end 20. The first end 18 is pivotally coupled to the locking arm mount 12 such that the arm 16 is selectively positionable between a first position extending away from the frame and a second position extending across the door 6. The first end 18 is positioned between and pivotally coupled to the plates 14. The arm 16 is preferably telescoping and includes a first portion 22 is slidably positioned in a second portion 24. The telescoping nature of the arm 16 allows the assembly 10 to be easily retrofitted to existing doorframes. A loop 26 is attached to the arm 16. The loop 26 is positioned generally adjacent to the second end 20 of the arm 16.

A lock mount 28 is fixedly attached to the second side 8 of the doorframe 5. Again, welding is the preferred method of attaching the lock mount 28 to the doorframe 5 though other conventional attachment means may be utilized. The lock mount 28 is positioned such that the second end 20 of the arm 16 may abut the lock mount 28 when the arm 16 is in the second position. The lock mount 28 includes a rod 30 that is attached to the second side 8. A cylinder 32 has a perimeter wall 34 attached to an end of the rod 30 and is positioned adjacent to the door 6 such that a plane of the door 6, when the door 6 is in a closed position, extends through the cylinder 32. The cylinder 32 preferably has a diameter generally between 3 inches and 5 inches. It is preferred that less than half of the cylinder 32 extends above the plane of the door 6. The perimeter wall 34 has a slot 36 extending therethrough. The slot 36 is positioned for receiving the loop 26. The cylinder 32 has an inner edge 38 and an outer edge 40. The inner edge 38 is positioned adjacent to the frame 5. A bar 42 is mounted in the cylinder 32 and is positioned adjacent to the outer edge 40. The bar 42 is preferably positioned in a plane orientated parallel to a plane of the door 6 and is positioned nearer an upper edge of the cylinder 32, as defined by the position of the slot 36, as opposed to a lower edge of the cylinder 32.

In use, the assembly is attached to the doorframe 5 as indicated above. The arm 16 is extended over the door 6 so that the loop 26 is positioned in the slot 36. A conventional lock 44, such as a padlock, may be positioned in the cylinder 32 and positioned on the loop 26 for selectively locking the arm 16 in the second position. The bar 42 helps to prevent tampering with lock 44.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door locking assembly for selectively locking a door in a closed position, said assembly comprising:

a doorframe including a first side and a second side positioned opposite with respect to each other and facing laterally away from the door, a door being mounted on said doorframe such that said door may only be opened outwardly;

a locking arm mount being fixedly attached to the first side of the doorframe;

an arm having a first end and a second end, said first end being pivotally coupled to said locking arm mount such that said arm is selectively positionable between a first position extending away from the frame and a second position extending across the door, a loop being attached to said arm, said loop being positioned generally adjacent to said second end of said arm;

a lock mount being fixedly attached to the second side of the doorframe, said lock mount being positioned such that said second end of said arm may abut said lock mount when said arm is in said second position, said lock mount including a rod being attached to said second side, a cylinder having a perimeter wall attached to an end of said rod and being positioned adjacent to the door such that a plane of the door extends through said cylinder, said perimeter wall having a slot extending therethrough, said slot being positioned for receiving said loop, said cylinder having an inner edge and an outer edge, said inner edge being positioned adjacent to the frame, a bar being mounted in said cylinder, said bar being positioned adjacent to said outer edge; and wherein a lock may be positioned in said cylinder and positioned on said loop for selectively locking said arm in said second position, wherein the lock is positioned between said bar and said inner edge of said cylinder.

2. The locking assembly of claim 1, wherein said locking arm mount includes a pair of plates being spaced from each other, each of said plates being in a plane orientated substantially parallel to each other, said first end being positioned between and pivotally coupled to said plates.

3. The locking assembly of claim 1, wherein said arm is telescoping and includes a first portion being slidably positioned in a second portion.

4. A door locking assembly for selectively locking a door in a closed position, said assembly comprising:

a doorframe including a first side and a second side positioned opposite with respect to each other and facing laterally away from the door, a door being mounted on said doorframe such that said door may only be opened outwardly;

a locking arm mount being fixedly attached to the first side of the doorframe, said locking arm mount including a pair of plates being spaced from each other, each of said plates being in a plane orientated substantially parallel to each other;

an arm having a first end and a second end, said first end being pivotally coupled to said locking arm mount such that said arm is selectively positionable between a first position extending away from the frame and a second position extending across the door, said first end being positioned between and pivotally coupled to said plates, said arm being telescoping and including a first portion being slidably positioned in a second portion, a loop being attached to said arm, said loop being positioned generally adjacent to said second end of said arm;

a lock mount being fixedly attached to the second side of the doorframe, said lock mount being positioned such that said second end of said arm may abut said lock mount when said arm is in said second position, said lock mount including a rod being attached to said second side, a cylinder having a perimeter wall attached to an end of said rod and being positioned adjacent to the door such that a plane of the door extends through said cylinder, said perimeter wall having a slot extending therethrough, said slot being positioned for receiving said loop, said cylinder having an inner edge and an outer edge, said inner edge being positioned adjacent to the frame, a bar being mounted in said cylinder, said bar being positioned adjacent to said outer edge; and wherein a lock may be positioned in said cylinder and positioned on said loop for selectively locking said arm in said second position, wherein the lock is positioned between said bar and said inner edge of said cylinder.

5. A method of locking door providing the steps of:

providing a doorframe including a first side and a second side positioned opposite with respect to each other and facing laterally away from the door, a door being mounted on said doorframe such that said door may only be opened outwardly;

providing a locking arm mount being fixedly attached to the first side of the doorframe, said locking arm mount including a pair of plates being spaced from each other, each of said plates being in a plane orientated substantially parallel to each other;

providing an arm having a first end and a second end, said first end being pivotally coupled to said locking arm mount such that said arm is selectively positionable between a first position extending away from the frame and a second position extending across the door, said first end being positioned between and pivotally coupled to said plates, said arm being telescoping and including a first portion being slidably positioned in a second portion, a loop being attached to said arm, said loop being positioned generally adjacent to said second end of said arm;

providing a lock mount being fixedly attached to the second side of the doorframe, said lock mount being positioned such that said second end of said arm may abut said lock mount when said arm is in said second position, said lock mount including a rod being attached to said second side, a cylinder having a perimeter wall attached to an end of said rod and being positioned adjacent to the door such that a plane of the door extends through said cylinder, said perimeter wall having a slot extending therethrough, said slot being positioned for receiving said loop, said cylinder having an inner edge and an outer edge, said inner edge being positioned adjacent to the frame, a bar being mounted in said cylinder, said bar being positioned adjacent to said outer edge; and providing a padlock;

positioning said loop in said slot; and locking said padlock on said slot such that said padlock is positioned between said bar and said inner edge of said cylinder.

* * * * *